US008251146B2

(12) United States Patent
O'Brien

(10) Patent No.: US 8,251,146 B2
(45) Date of Patent: Aug. 28, 2012

(54) FRAC SLEEVE SYSTEM AND METHOD

(75) Inventor: Robert S. O'Brien, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 383 days.

(21) Appl. No.: 12/485,185

(22) Filed: Jun. 16, 2009

(65) Prior Publication Data

US 2010/0314133 A1 Dec. 16, 2010

(51) Int. Cl.
*E21B 34/08* (2006.01)
*E21B 34/14* (2006.01)

(52) U.S. Cl. ..... 166/318; 166/321; 166/375; 166/386

(58) Field of Classification Search ..... 166/386, 166/318, 375, 321
See application file for complete search history.

(56) References Cited

U.S. PATENT DOCUMENTS 7,387,165 B2 6/2008 Lopez de Cardenas et al.
2009/0014168 A1* 1/2009 Tips et al. ..... 166/73

OTHER PUBLICATIONS

Constantine, Jesse J. "Selective Production of Horizontal Openhole Completions Using ECP and Sliding Sleeve Technology," SPE Rocky Mountain Regional Meeting, May 15-18, 1999, Gillette, Wyoming. [Abstract Only].

Garfield, Garry. "Through-Tubing Casing Exist and Inflatable Technologies Combine to Deliver Enhanced Production During Coiled Tubing Drilling Campaign in the Middle East," IADC/SPE Asia Pacific Drilling Technology Conference and Exhibition, Jakarta, Indonesia, Aug. 25-27, 2008.

Vargus et al. "Completion System Allows for Interventionless Stimulation Treatments in Horizontal Wells with Multiple Shale Pay Zones," SPE Annual Technical Conference and Exhibition, Sep. 21-24, 2008, Denver, Colorado, USA. [Abstract and Introduction Only].

Garfield, Garry, Baker Oil Tools "Through-Tubing Casing Exit and Inflatable Technologies Combine to Deliver Enhanced Production during Coiled Tubing Drilling Campaign in The Middle East", IADC/SPE 114669, Asia Pacific Drilling Technology Conference and Exhibition, Jakarta, Indonesia, Aug. 25-27, 2008, pp. 1-7.

* cited by examiner

*Primary Examiner* — Giovanna Wright
(74) *Attorney, Agent, or Firm* — Cantor Colburn LLP

(57) ABSTRACT

A system including a plurality of differential pressure actuated tools; a seat receptive to a plug; a first conduit fluidly communicating tubing pressure upstream of the seat to one end of each of the plurality of tools; and a second conduit fluidly communicating tubing pressure downstream of the seat to an opposite end of each of the plurality of tools and method.

20 Claims, 1 Drawing Sheet

FRAC SLEEVE SYSTEM AND METHOD

BACKGROUND

Fracturing and other pressure based operations that occur at intervals along the length of a borehole often rely upon plugs (balls, darts, etc.) that are dropped or pumped to seats installed within the borehole. Upon landing at individual ones of such seats, pressure may be applied to actuate a tool or fracture a formation location. Because of a limited number of plug diameters that are practically possible, such systems are limited in the number of pressure events that can be created.

While the art has been using such systems for years and coping well with the limitations thereof, an alternative that would increase the number of events that could be created would be welcomed by the art.

SUMMARY

A system including a plurality of differential pressure actuated tools; a seat receptive to a plug; a first conduit fluidly communicating tubing pressure upstream of the seat to one end of each of the plurality of tools; and a second conduit fluidly communicating tubing pressure downstream of the seat to an opposite end of each of the plurality of tools.

A method for actuating a plurality of tools in a downhole environment including deploying a plug into a borehole including a plurality of differential pressure actuated tools; a seat receptive to a plug; a first conduit fluidly communicating tubing pressure upstream of the seat to one end of each of the plurality of tools; and a second conduit fluidly communicating tubing pressure downstream of the seat to an opposite end of each of the plurality of tools; landing the plug in the seat; creating a differential pressure across each of the plurality of tools; and actuating the plurality of tools with the differential pressure.

BRIEF DESCRIPTION OF THE DRAWINGS

Referring now to the drawings wherein like elements are numbered alike in the Figures.

DETAILED DESCRIPTION

Figure 1:
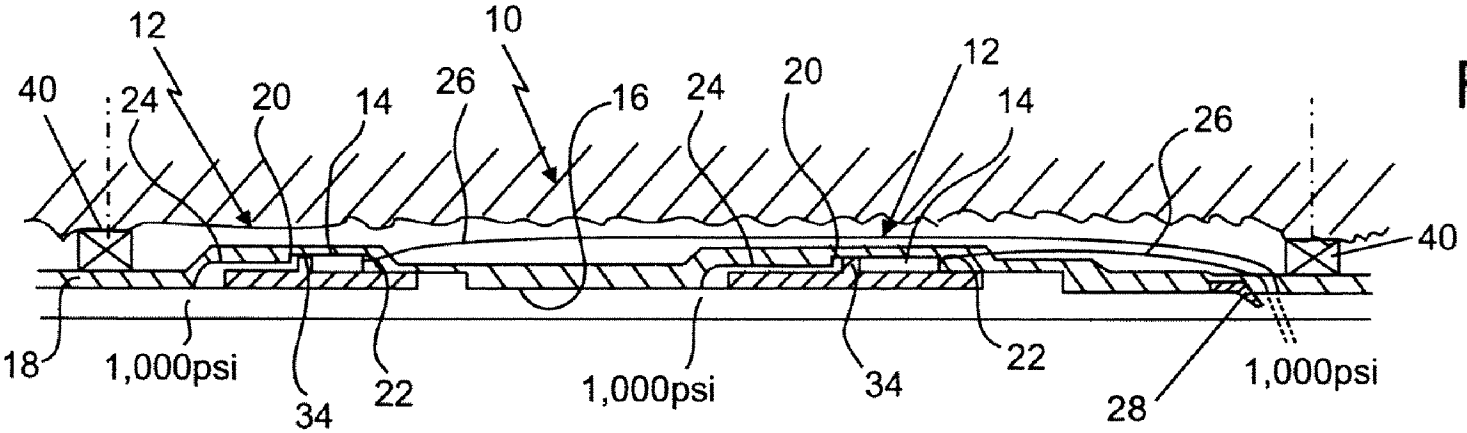
FIG. 1 is a schematic illustration of a frac sleeve system in a pre actuation condition.

Referring to FIG. 1, a system 10 having more than one actuable tool 12 is illustrated. In the illustrations herein only two tools 12 are illustrated but it is to be appreciated that any plurality of tools 12 may be employed in the system. The overall concept of the system and method is the facilitation of an ability to actuate a plurality of tools based upon pressure applied from a remote location pursuant to a single plug being landed. The prior art, as noted above only actuates one tool per plug while the invention actuates any plurality.

As illustrated simply for ease of discussion, the tools 12 are sliding sleeves that include piston chambers 14 that are ported to the ID 16 of a string 18 at both an uphole end 20 and a downhole end 22 by conduits 24 and 26, respectively. The conduits 24 and 26 may actually comprise control line run from the ends of the piston chambers 14 or may be simply fluid pathways through the tools. It is unimportant to the operation of the system how the fluid within the piston chamber is communicated to the ID upstream and downstream of the seat 28 but rather only that it is so communicated for that is the configuration that allows a differential pressure to be provided to a plurality of tools simultaneously. It is to be appreciated that both, or all in the case of more tools 12, of the conduits 26 fluidly connect with the ID 16 downstream of a seat 28 while both, or all in the case of more tools 12, of the conduits 24 fluidly connect to the ID 16 upstream of the seat 28. The seat, with an accompanying plug 32 (see FIG. 2), then provides for the differential pressure noted above that is generatable across both (or all) of tools 12 at the same time. The tools 12 are actuated simultaneously by pressuring up on the string 18 after the seating of the single plug 32 (see FIG. 2).

It is also to be noted that it is not important where the conduits 24 and 26 end up connecting to the ID other than that conduits 24 must connect at one of upstream and downstream of the seat 28 and conduits 26 must connect at the other of upstream or downstream of the seat 28, or in other words across the seat 28, so that differential pressure can be generated. Where precisely they connect after that consideration is met is a matter of manufacturing convenience and material cost. Further, although in the example both of the tools 12 are "actuated" at the same time that does not necessarily mean that they must both move at the same rate to open. In some particular applications, one or more could be delayed if desired but the actuation pressure, which is a differential pressure across the seat 28, and hence across pistons 34 in each chamber 14, occurs simultaneously.

Figure 2:
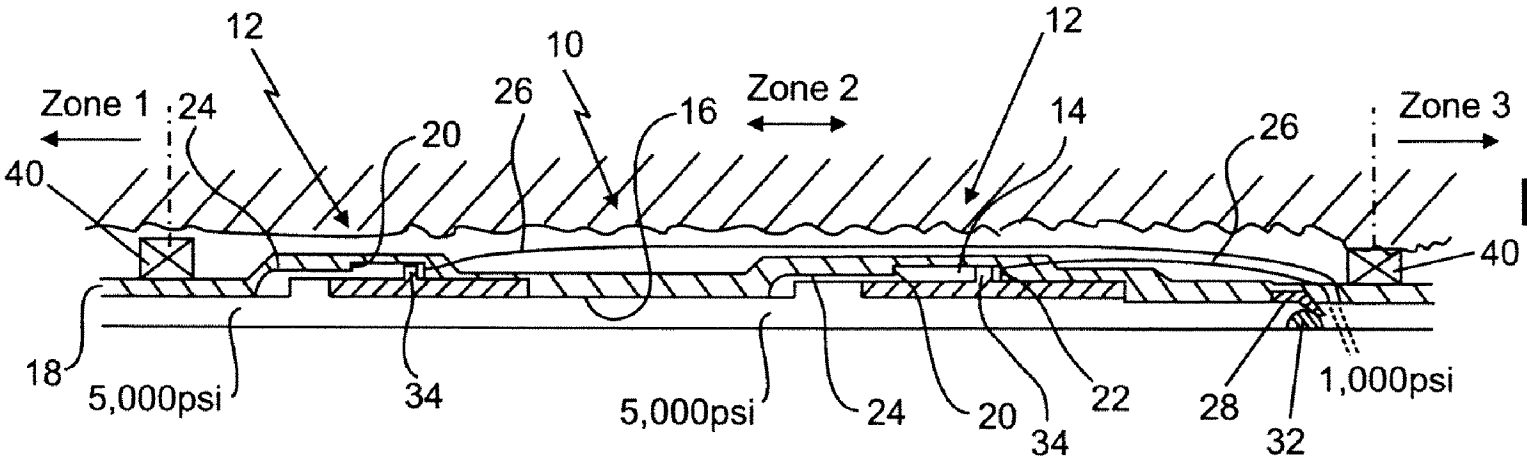
FIG. 2 is a schematic view of the same system in the actuated position.

It is to be appreciated that the system illustrated in FIGS. 1 and 2 can be stacked. This may be effected schematically simply by copying FIG. 1 and pasting the duplicate longitudinally adjacent the first illustration. Each system then would have a plurality of tools 12, a seat 28, a set of conduits 24 fluidly connected to the string 18 on one side of the seat 28 and a set of conduits 26 fluidly connected to the string 18 on the other side of the seat 28.

In a borehole configured with the system as disclosed, one or more of the systems 10 may be employed and in some embodiments a large number of the systems are employed. The number of tools 12 actuated by each plug 32 is not limited and the number of systems 10 is limited only by the number of configurations, such as plugs, that can produce a location across which differential pressure may be generated.

With respect to other pluralities of tools that are uphole of the plurality of tools shown in FIGS. 1 and 2, these will not be actuated by the pressure in the string 18 that is intended to actuate the plurality of tools 12 that are shown. This is because if there is no plug 32 in a seat that is associated with a particular plurality of tools 12, there can be no pressure differential developed across the pistons 34. Rather, pressurization of the string 18 without a plug 32 in a seat 28 that is associated with a particular plurality of tools 12 is applied to both sides of the piston chambers 14, whereby the piston 34 in each will not move. A Seat 28 considered "associated" with a particular plurality of tools 12 is the seat 28 that is located between conduits 24 and 26 for a particular plurality of tools 12.

Following tool actuation, pressure may also be used to, for example, fracture the formation through the tools, which may be, for example, valves such as open sliding sleeves, for example. Since other tools are experiencing balanced pressure, they and the formation at those tools is unaffected. Uphole of the particular system, the tools are unactuated and thence pressure is irrelevant and downhole of the particular system, pressure is hydrostatic alone due to the seated plug 32 at the particular system. It will be appreciated that seals 40 are positioned outside of string 18 to isolate individual zones.

Finally it is to be understood while one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A system comprising:

a plurality of differential pressure actuated tools;

a seat receptive to a plug;

a first conduit fluidly communicating tubing pressure upstream of the seat to one end of each of the plurality of tools; and a second conduit fluidly communicating tubing pressure downstream of the seat to an opposite end of each of the plurality of tools.

2. A system as claimed in claim 1 wherein the plug is a ball.

3. A system as claimed in claim 1 wherein the plug is a dart.

4. A system as claimed in claim 1 wherein the plurality of tools each include a piston chamber.

5. A system as claimed in claim 4 wherein the piston chamber is bifurcated by a piston.

6. A system as claimed in claim 5 wherein the first conduit is fluidly connected to the piston chamber at one side of the piston and the second conduit is connected to the piston chamber at the other side of the piston.

7. A system as claimed in claim 5 wherein the first conduit is fluidly connected to the piston chamber at one side of the piston and the second conduit is connected to the piston chamber at the other side of the piston.

8. A system as claimed in claim 4 wherein the piston chamber is bifurcated by a piston.

9. A system as claimed in claim 1 wherein one of the first and second conduit is a pathway.

10. A system as claimed in claim 1 wherein one of the first and second conduit is a control line.

11. A system as claimed in claim 1 wherein the plurality of tools include one or more valves.

12. A system as claimed in claim 1 wherein the plurality of tools include one or more sliding sleeves.

13. A method for actuating a plurality of tools in a downhole environment comprising:

deploying a plug into a borehole comprising the system claimed in claim 1;

landing the plug in the seat;

creating a differential pressure across each of the plurality of tools; and actuating the plurality of tools with the differential pressure.

14. A system as claimed in claim 1 wherein the plug is a ball.

15. A system as claimed in claim 1 wherein the plug is a dart.

16. A system as claimed in claim 1 wherein the plurality of tools each include a piston chamber.

17. A system as claimed in claim 1 wherein one of the first and second conduit is a control line.

18. A system as claimed in claim 1 wherein the plurality of tools include one or more valves.

19. A system as claimed in claim 1 wherein the plurality of tools include one or more sliding sleeves.

20. A system comprising:

a plurality of differential pressure actuated tools;

a seat receptive to a plug;

a first conduit fluidly communicating tubing pressure upstream of the seat to one end of each of the plurality of tools; and a second conduit fluidly communicating tubing pressure downstream of the seat to an opposite end of each of the plurality of tools, the system configured to be actuated by landing the plug into the seat to create a differential pressure across each of the plurality of tools.

* * * * *